US005297363A

United States Patent [19]

Schroder et al.

[11] Patent Number: 5,297,363

[45] Date of Patent: Mar. 29, 1994

[54] PORTABLE SURFACE PREPARATION ABRADING UNIT

[76] Inventors: Lowell W. Schroder, R.D. #3, Box 298, Red Lion, Pa. 17356; Robert G. Ward, State Rte. 1352, Box 476, Townsville, N.C. 27584

[21] Appl. No.: 952,094

[22] Filed: Sep. 28, 1992

[51] Int. Cl.[5] ..... B24B 27/033; B24B 55/10

[52] U.S. Cl. ..... 51/170 PT; 51/180; 51/273

[58] Field of Search ..... 51/170 R, 170 PT, 174, 51/176, 180, 273, 334

[56] References Cited

U.S. PATENT DOCUMENTS

| | | | |
|---|---|---|---|
| 1,412,725 | 4/1922 | Vernon | 51/170 PT |
| 1,728,487 | 9/1929 | Gardner | 51/176 |
| 1,800,341 | 4/1931 | Davies | 51/180 |
| 1,810,336 | 6/1931 | Bennington | 51/170 PT |
| 1,831,554 | 11/1931 | Domres | 51/170 PT |
| 1,914,280 | 6/1933 | Myers | 51/176 |
| 2,127,851 | 8/1938 | Wadhams | 51/176 |
| 2,179,963 | 11/1939 | Spadone | 51/176 |
| 2,232,733 | 2/1941 | Scarboro | 51/170 PT |
| 3,701,221 | 10/1972 | Vinella | 51/273 |
| 4,124,956 | 11/1978 | Levinson | 51/273 |
| 4,149,345 | 4/1979 | Atsuchi | 51/424 |
| 4,276,673 | 7/1981 | Brook | 15/49 C |
| 4,375,740 | 3/1983 | Brown | 51/425 |
| 4,422,239 | 12/1983 | Maier et al. | 30/124 |
| 4,782,632 | 11/1988 | Matechuk | 51/180 |

FOREIGN PATENT DOCUMENTS

| | | | |
|---|---|---|---|
| 189576 | 12/1922 | United Kingdom | 51/170 R |

*Primary Examiner*—Bruce M. Kisliuk
*Assistant Examiner*—Bryan Reichenbach
*Attorney, Agent, or Firm*—Samuel M. Learned, Jr.

[57] ABSTRACT

A portable surface preparation abrading unit which enables the quick and efficient mechanical removal of a work surface coating or fouling film with low loss and collection of removed material dust and debris for safe disposal thereof so that operations such as boat hull and auto body cleaning or paint removal, for example, may be carried out without an inordinant hazard of contaminating the ambient work area environment.

14 Claims, 5 Drawing Sheets

16
38
40
22
62
20
120
24
152
108
122
118
168
160
158
132
130
164
162
165
122
156
154
166
116
166
132
150
124
128
4
4
112
104
126
114
6
6
112
110
114
118
5
170
116
106
170
148
134
136
144
5
138
140
142
146

PORTABLE SURFACE PREPARATION ABRADING UNIT

BACKGROUND OF THE INVENTION

The present invention relates to a portable surface preparation abrading unit of that type which is employed to safely remove surface coatings of a toxic or hazardous nature without contaminating the ambient work area environment, such as metallic bottom paints used on boat hulls and the like, and to collect the removed surface coating dust and debris for environmentally safe disposal.

Other than for the slow and costly process of manual removal of toxic or environmentally unsafe surface coatings, the hazardous nature of which may be due to the coating itself or a fouling film upon the surface, or a combination thereof, the two basic mechanically assisted manually portable means for removing such coatings are by either some sort of so-called blasting apparatus which incorporates the use of a pressurized slurry or air stream to fluidize and direct abrading particulate matter such as sand against the coating or film on the surface to be cleaned or prepared, or a mechanically driven sanding unit with either orbital or rotary sanding elements in combination with a vacuum source in order to draw off the surface removed dust and debris so that it does not contaminate the work area environment and also to collect the same for safe handling and environmentally safe disposal.

Exemplary of the portable blasting type of surface preparation apparatus would be those as respectively taught by Atsuchi in U.S. Pat. No. 4,149,345 dated Apr. 17, 1979, for a recirculating sand blaster specifically adapted for use in cleaning ship hulls, and by Brown in U.S. Pat. No. 4,375,740 dated Mar. 8, 1983, for a hand-held portable blasting unit also embodying a recycling abrasive system.

With regard to the exemplary sanding unit type of surface preparation unit with vacuum removal of dust and debris, typical teachings would be those as respectively set forth in U.S. Pat. No. 4,422,239 to Maier et al dated Dec. 27, 1983, and U.S. Pat. No. 4,782,632 to Matechuk dated Nov. 8, 1988, the latter of which also embodies the use of a flexible drive shaft component for the orbital sander.

Applicants herein by their teaching disclose in addition to a vacuum system removal means, the use of a flexible drive for operating the sander, another teaching of which shows a similar such use being that of Brook in U.S. Pat. No. 4,276,673 dated Jul. 7, 1981, for a flexible drive shaft upon a floor wax stripping apparatus.

The applicants herein by their invention, however, provide a convenient new and novel portable surface preparation abrading unit having the advantage of being able to mechanically remove a surface coating with ease and efficiency substantially without dust and debris contamination therefrom of the ambient work area environment, and with highly efficient means to withdraw and collect the removed dust and debris for safe handling and environmentally safe disposal thereafter.

SUMMARY OF THE INVENTION

It is the principal object of the present invention to provide a portable surface preparation abrading unit adapted to be connectably assembled to a remote rotational drive power source for operation of a flap wheel sanding drum contained within the hand-held workhead housing thereof, as well as also being concurrently connectably assembled to a remote vacuum system to thereby provide a pressure differential within the hand-held workhead housing for aspirated collection and transport of dust and debris as it is removed from a work surface on out through the workhead housing discharge port and by way of an interconnected vacuum conduit to containment within the vacuum system collection means, whereby substantially all abradably removed work surface dust and debris is captured and contained for disposal with low loss thereof to contaminate the ambient work area environment.

It is another object of the present invention to provide a portable surface preparation abrading unit whereby the rotationally driven flap wheel sanding drum thereof operates in such a manner so as to direct dust and abradably removed debris from the work surface into the pressure differential vacuum flow air stream created within the workhead housing to thereby optimize workhead efficiency in the collection and containment of contaminant dust and debris.

A further object of the present invention is to provide a surface preparation abrading unit having a workhead housing which directs the vacuum flow air stream path in such a manner so as to effect a cooling of the flap wheel sanding drums during operational use employment.

It is likewise an object of the present invention to provide a surface preparation abrading unit adapted to employ flap wheel sanding elements which substantially reduces loading up of the abrading means and thereby reduces both cost and downtime due to replacement.

It is also an object of the present invention to provide a surface preparation abrading unit which enables the quick change and replacement of flap wheel sanding inserts from one grade to another, or to alternate abrading means such as wire brushes or the like, for accommodating different abrading conditions and requirements in accomplishing preparation and cleaning upon different structural base materials.

An additional object of the present invention is to provide a surface preparation abrading unit which incorporates the employment of an abrading means that articulates to the profile of the work surface contour whether flat, convex, concave or undulatory, or a combination thereof such as for example on boat hulls and auto bodies.

A further object of the present invention is to provide a surface preparation abrading unit which has a hand-held workhead housing that is sufficiently light and compact to be able to be manually positioned upon and operationally moved with relative ease and facility for extended periods over a surface to be worked.

Yet another object of the present invention is to provide a surface preparation abrading unit which embodies the use of a flexible drive shaft in connection of the remote rotational drive power source to the flap wheel sanding drum, which flexible drive shaft is snaked through the workhead housing interconnected vacuum conduit to thereby contain all workhead connectors within a single line for enhanced operator ease and efficiency during use.

It is also an object of the present invention to provide a surface preparation abrading unit whereby operational torque vibration set up in the flexible drive shaft housed within the interconnected vacuum conduit effects a vibratory means whereby the vacuum conduit is continually shaken and accumulation of dust and debris therewithin and clogging thereof is thereby prevented.

An additional object of the present invention is to provide a surface preparation abrading unit wherein the work surface removed dust and debris is separated from the aspirating air stream by means of collection bags.

Still another object of the present invention is to provide a surface preparation abrading unit with a hand-held workhead housing adapted to protectively cover and enclose the operable work surface area in a substantially air tight manner.

It is also an object of the present invention to provide a surface preparation abrading unit which is mechanically simple and economical to make and operate.

The foregoing, and other objects hereof, will be readily evident upon a study of the following specification and the accompanying drawings comprising a part thereof.

DETAILED DESCRIPTION OF THE INVENTION

Figure 1:
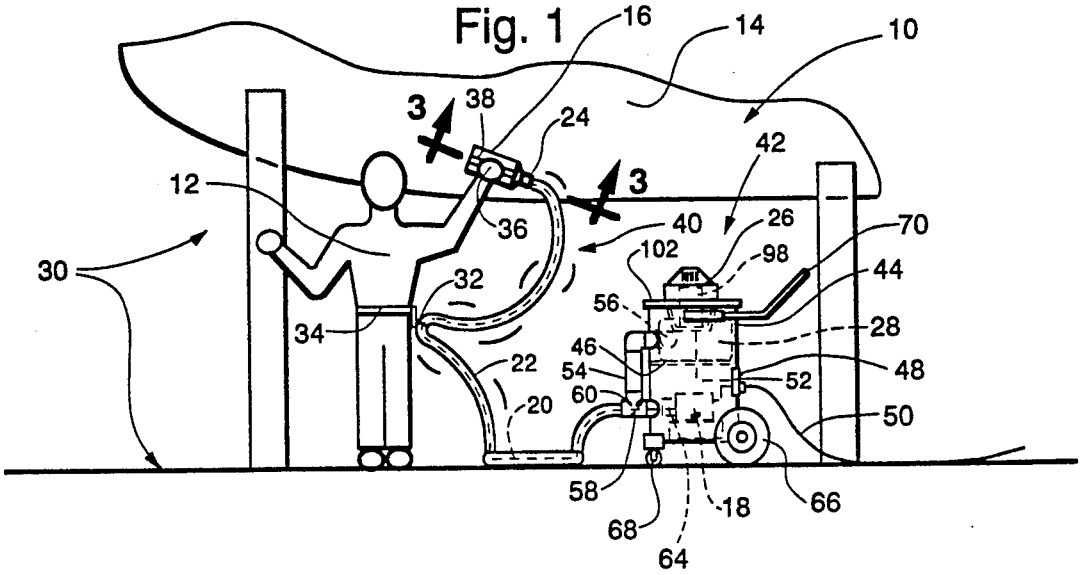
FIG. 1 is a diagrammatic illustration of a typical worker employing the portable surface preparation abrading unit of instant invention in the exemplary use application of cleaning and conditioning a boat hull for bottom painting.

Referring to FIG. 1, the portable surface preparation abrading unit 10 of present invention is shown as being employed by a typical worker 12 in the exemplary use application of cleaning and conditioning a boat hull bottom 14 for bottom painting, wherein the component parts of said portable surface preparation abrading unit 10 comprising the same are a hand-held workhead housing 16 which is connected to a power source 18 such as an electric motor or the like by means of a flexible drive shaft 20 to thereby operate the rotary abrading units within said workhead housing 16, and a vacuum conduit 22 through which said flexible drive shaft 20 runs and which connects the discharge port 24 of said workhead housing 16 to a vacuum source 26 to thereby create a pressure differential within said workhead housing 16 whereby the aspirated transport of work surface abradably removed dust and debris is delivered to vacuum source collection bags 28 for containment and collection thereby, and subsequent removal for environmentally safe disposal, such that the ambient work area environment 30 is kept substantially free of contamination from work surface abradably removed dust and debris.

Referring again to FIG. 1 to consider additional structural and functional features of the portable surface preparation abrading unit 10, the primary use feature of which is the high degree of portability thereof. It will be noted that both the power source 18 and vacuum source 26 are remote from the hand-held workhead housing 16, thereby enabling a lighter and more compact workhead housing unit. It will also be noted that a swivel clip 32 is provided upon the vacuum conduit 22 at a location adjustably set by the worker 12 so that he may attach the swivel clip 32 to his belt 34 for example, in the manner generally illustrated, and thereby substantially reduce the flexible drive shaft 20 and vacuum conduit 22 weight load which would otherwise be carried by his operational hand 36 in securing the workhead housing handle 38 for manually positioning and operationally moving the hand-held workhead housing 16, so that a worker 12 may do so with relative ease and facility for extended periods over the surface to be worked, in the instant case being exemplified by the boat hull bottom 14. Another functional advantage of having the power source 18 and vacuum source 26 remote from the workhead housing 16 is that, again because of a lighter and more compact workhead housing unit, one is thereby also enabled to operate in more restricted work areas than would otherwise be possible.

The preferred embodiment of the portable surface preparation abrading unit 10 as illustrated in FIG. 1 shows the portable surface preparation abrading unit working assembly 40, which is comprised of the hand-held workhead housing 16 with flexible drive shaft 20 and vacuum conduit 22, assembled to a modified industrial vacuum cleaner 42 such as those typically used in heavy duty applications for cleaning shop and production area floors and the like, wherein the vacuum cleaner cannister 44 thereof has been internally partitioned with a diaphragm 46 so that the vacuum source 26 and collection bags 28 are housed in the upper portion, and the power source 18 for the flexible drive shaft 20 is housed in the lower portion, wherein the respective motors of the vacuum source 26 and flexible drive shaft power source 18 operate off a single switch 48 to control electrical current through conduit cable 50 fed thereby into the electrical control box 52.

The modified industrial vacuum cleaner 42 has been further adapted by means of an auxilliary vacuum conduit 54 and T-fitting 56 to accommodate two collection bags 28 and thereby increase the collection bag surface area, reduce the resistance to air flow therethrough, and consequently increase the vacuum system opoerational efficiency. The auxiliary vacuum conduit 54 also provides a deflector 58 which directs the vacuum air flow from the vacuum conduit 22 through the auxilliary vacuum conduit intake 60 and into the auxilliary vacuum conduit 54 through the T-fitting 56 and therefrom into the collection bags 28. The deflector 58 also provides a sealing means whereby the flexible drive shaft 20 and flexible drive shaft housing 62, as is more clearly shown in FIG. 2 to be hereinafter described in detail, are admitted from the vacuum conduit 22 for connection by motor coupling 64 to the power source 18.

Additional adaptations of the modified industrial vacuum cleaner 42 to better accommodate it to service in the instant application is the addition of a set of pneumatic tires 66 and casters 68, and a handle 70. Thus, complementary portability of the modified industrial vacuum cleaner 42 and the power source 18 contained therein is also provided.

An additional aspect of the portable surface preparation abrading unit 10 operation that is best illustrated in FIG. 1 than elsewhere is that as the worker 12 applies the rotating abrading units of the hand-held workhead 16 to the surface 14 to be worked, and an increased torque load is thereby placed upon the power source 18, the flexible drive shaft 20 tends to vibrate and shake the vacuum conduit 22 sufficiently so that any tendency of the removed dust and debris to collect within and clog up the vacuum conduit 22 interior passageway is prevented by the aforedescribed flexible drive shaft 20 vibratory torque load phenomenon.

The portable surface preparation abrading unit 10 and sub-assembly component parts thereof such as the hand-held workhead housing 16 and portable surface preparation abrading unit working assembly 40, as well as other parts shown and illustrated in FIG. 1 and certain subsequent Figures hereinafter, may be fabricated by accepted manufacturing methods and techniques from various metals and alloys thereof, or plastics, or combinations of metals, metal alloys, and plastics.

Figure 2:
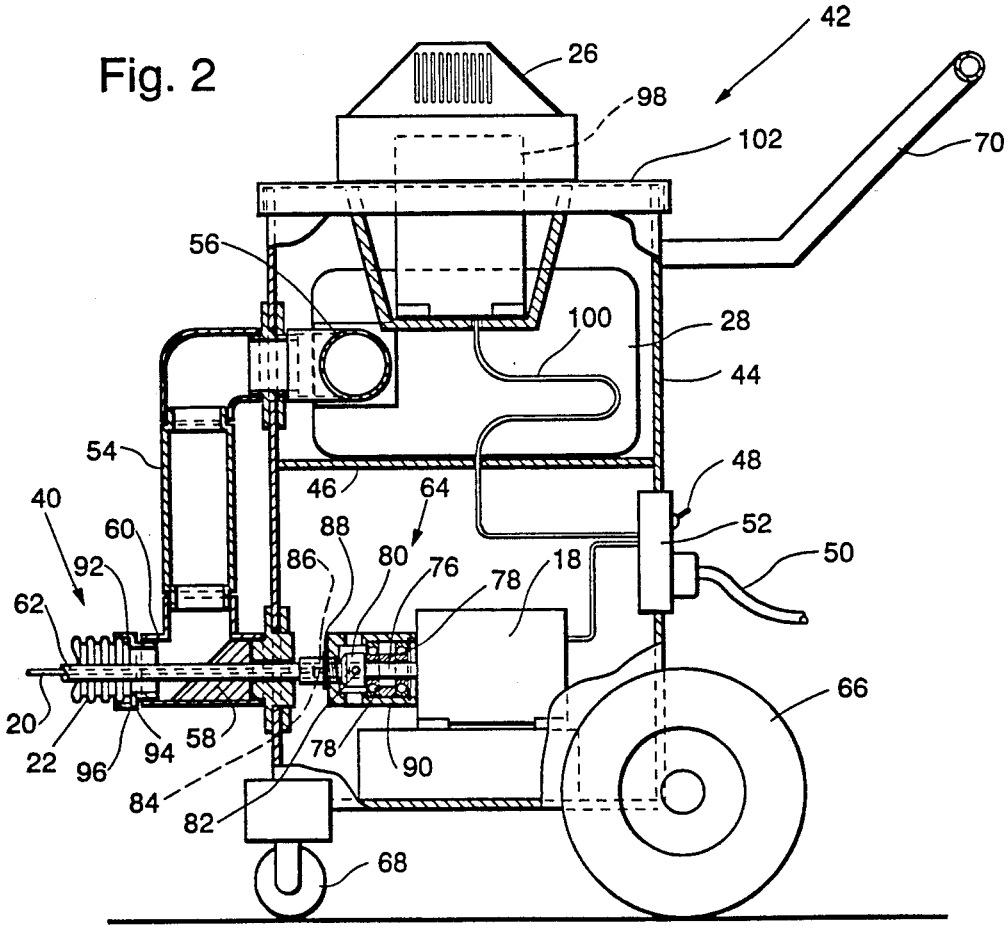
FIG. 2 is an enlarged side elevation view of the portable surface preparation abrading unit power and vacuum system with the side thereof broken away to better show interior working assemblies thereof.

Referring now to the enlarged cut-away side elevation view of the modified industrial vacuum cleaner 42 as shown in FIG. 2 to better describe connection of the portable surface preparation abrading unit working assembly 40 thereto, and considering first connection of the flexible drive shaft 20 to the power source 18 by means of the motor coupling 64. It will be noted that the power source drive shaft 76, being journaled within a set of spaced bearings 78, has a flexible drive shaft power source connector 80 assembled thereto by means of a power source drive shaft connector set screw 82. A forward projecting recessed nose 84 of the flexible drive shaft power source connector 80 is configured as a female fitting to insertably receive in close complementary slidable communication therewithin the forward projecting square male fitting extension 86 of the flexible drive shaft 20, all being held together by means of the flexible drive shaft coupling collar 88 threadable connection within the power source drive shaft journal housing 90. Thus, by means of the motor coupling 64, when the power source 18 is activated by switch 48 the power source drive shaft 76 rotary motion is thereby transmitted to the flexible drive shaft 20 which in turn, rotating within the flexible drive shaft housing 62 thereby imparts rotary motion to the rotating abrading units of the hand-held workhead housing 16 as will hereinafter be described in detail on consideration of FIG. 3.

The means of coupling the vacuum conduit 22 to the auxilliary vacuum conduit intake 60 is by twistably engaging the leading conduit rib 92 of said vacuum conduit 22 within the auxilliary conduit intake fitting 94 thread flange 96, whereupon the two are joined.

It will also be noted that the vacuum source motor 98 is provided with a slack power cable 100, thereby enabling extension thereof during removal of the vacuum cleaner top 102 with attached vacuum source 26 and motor 98 for purposes of taking out filled collection bags 28 and replacement thereof with new such bags 28.

Figure 3:
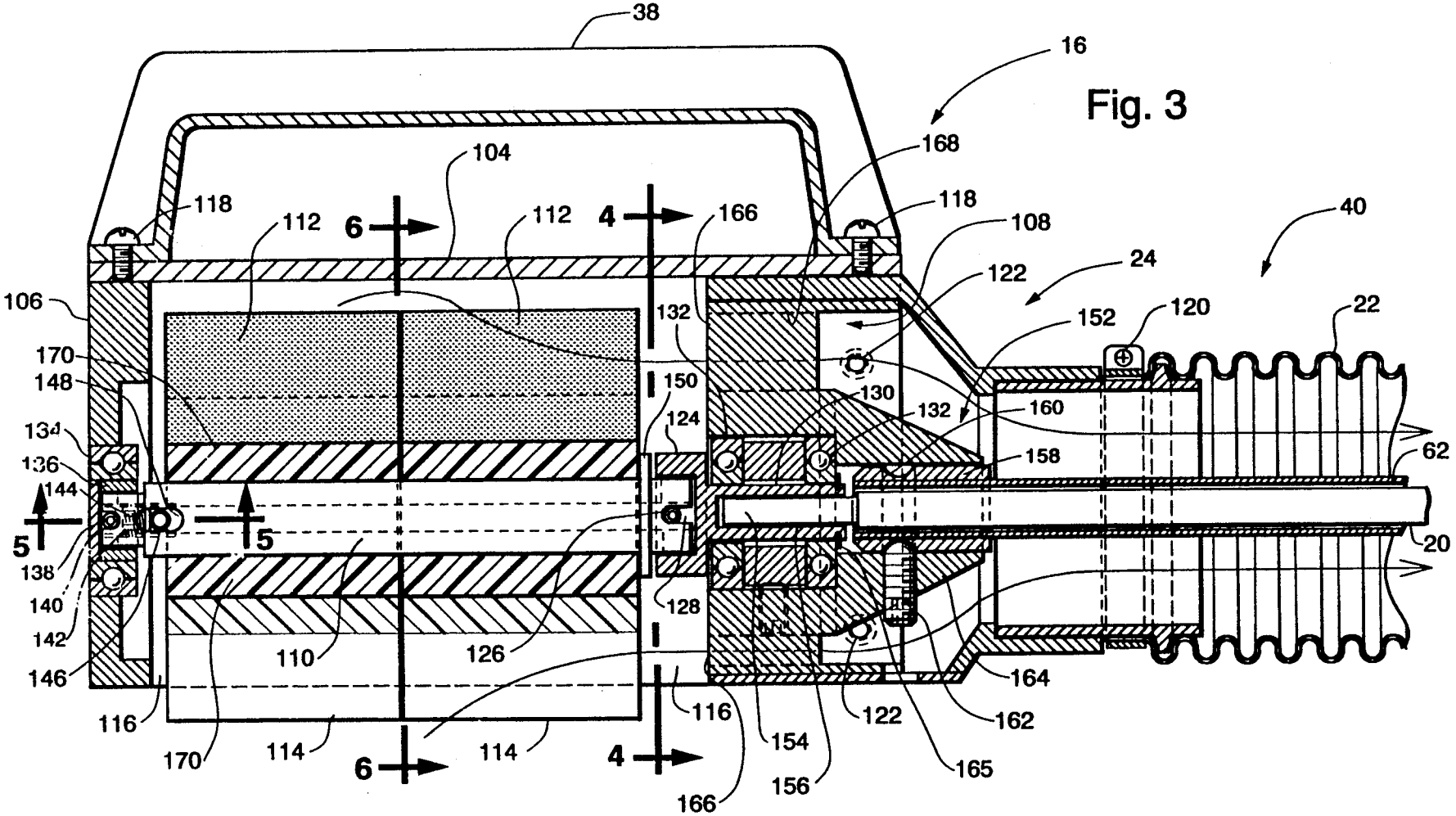
FIG. 3 is a side sectional view of the hand-held workhead housing, as shown in FIG. 1 and seen along the line 3—3 thereof.

Directing attention now to FIG. 3 and a detailed consideration of the hand-held workhead 16, which is employed as the portable surface preparation abrading unit 10 working tool. The workhead housing 16 describes a semi-circular cylindrical body 104 enclosed at the terminal end thereof by a complementary semi-circular shaped bearing mounting plate 106 which is integral to the body 104 structure, and at the vacuum conduit 22 connection end thereof by the semi-circular insertably disengagable discharge port bearing mounting spider 108, and rotatably contained between the plate 106 and spider 108 is the removable abrading unit mandrel 110 upon which in turn is removably assembled the working tool abrading means such as flap wheel sanding drums or wire brushes and the like, wherein the illustration shown in FIG. 3 is that of a complementary set of abuttably assembled flap wheel sanding drums 112 the abrading means working surfaces 114 of which rotatably articulate against a working surface, such as the boat hull bottom 14 previously illustrated in FIG. 1, through the workhead housing opening 116. The workhead housing 16 is further provided with a handle 38 as earlier described, which handle 38 is threadably secured to the housing 16 by means of handle screws 118. As also shown, the discharge port 24 is insertably assembled to the vacuum conduit 22 and pivotally retained thereto by means of a collar clamp 120. Peripherally about the discharge port 24 end of the workhead housing 16 is an aligned radially spaced plurality of workhead housing assembly screws 122 which serve to hold the semi-circular insertably disengageable discharge port bearing mounting spider 108 in place in the housing 16 when said screws 122 are inserted and secured for assembled operational use, and when the same are taken out allow slidable withdrawal of said spider 108, which is connectably housed as an integral structural component within said discharge port 24 and removable therewith, from said housing 16 for removal of the abrading unit mandrel 110 and replacement or change of the abrading means.

Considering now the workhead housing removable abrading unit mandrel mounting means, which at the drive end thereof consists of a drive key 124 comprised of a drive key collar having a drive key roll pin 126 mounted therein which insertably engages a mandrel shaft drive slot 128 such that when the drive key shaft 130 rotationally riding within a spaced set of discharge port spider bearings 132 is driven by the flexible drive shaft 20 then rotary motion is imparted to the removable abrading unit mandrel 110 and the abrading means assembled thereon. At the idler end of the workhead housing mandrel mounting means is an idler key comprised of an idler key bearing 134 having mounted within an idler collar 136 pressed within the interior race thereof an idler key roll pin 138 adapted to insertably engage a mandrel shaft idler slot 140 such that when said mandrel 110 is rotationally driven as above described the idler key provides complementary rotary support therefor. Thus, when the workhead housing assembly screws 122 are removed, and the insertably disengageable discharge port bearing mounting spider 108 is slidably disengaged rearwardly along with said discharge part 24 from the semi-circular cylindrical body 104 of the workhead housing 16, the respective roll pins 126 and 138 disengage from the corresponding mandrel shaft slots 128 and 140, and the abrading unit mandrel 110 is thereby released for removal.

Operational replacement of the removed mandrel mounted abrading unit by another such unit is accomplished by a reverse of the above described procedure. In the event, however, that the abrading units upon the mandrel 110 per se are to be replaced before reinstallation as a mandrel mounted abrading unit within said workhead housing 16, then the following procedure is employed. With the mandrel mounted abrading unit removed such that the mandrel shaft idler slot 140 is cleared, then access is provided to the set screw 142 which threadably engages within the axially aligned mandrel shaft threaded opening 144 to engage the abrading unit retention roll pin 146 and move the same within elongated slot 148 against the end face of the abrading unit, in this case a flap wheel sanding drum 112, until there is compressive retention thereof between the mandrel stop collar 150 and said abrading unit retention roll pin 146. Removal of said flap wheel sanding drums 112 from the mandrel 110 is accomplished by threadably disengaging the set screw 142 from compressive contact with the abrading unit retention roll pin 146, thereafter slidably withdrawing said pin 146 from the elongated slot 148, and then slidably removing the abrading units 112 from the mandrel shaft 110 by way of the idler slot 140 end thereof.

Operational replacement with new abrading units upon the mandrel shaft 110 is accomplished by a reverse of the above described procedure, by inserting the abrading unit hub openings upon said mandrel shaft 110 over the idler slot 140 end thereof and into compressible contact with the mandrel stop collar 150, and then securing with compressive retention by means of the set screw 142 and abrading unit retention roll pin 146 within elongated slot 148.

The workhead drive shaft coupling 152 is formed by engagement of the flexible drive shaft 20 with the drive key 124 and is by means of close complementary slidable insertion of the drive and square male drive shaft fitting extension 154 into the cooperatively conformed drive key shaft recess 156 whereby rotary motion imparted to the drive shaft 20 by the power source 18 is transmitted to the drive key 124 and thus to the removable abrading unit mandrel 110 and the flap wheel sanding drums 112 assembled thereon. In order to secure the drive fitting assembly of the drive end square male drive shaft fitting extension 154 within the drive key shaft recess 156 in such a way as to be sufficiently flexible so that motion and movement of the workhead housing 16 may be accommodated in use operation, without binding of the drive transmission means herein described, the workhead drive shaft coupling 152 is retained in place by means of a flexible drive shaft affixed cylinder collar 158 provided with a circumferential groove 160 therein which groove is nominally engaged retainably by a complementary bullet nosed set screw 162 secured in threadable extension perpendicularly through the bearing mounting spider extension flange 164 in such a manner as to allow relative axial rotation of said workhead housing 16 with respect to said workhead drive shaft coupling 152. It will be further noted that the drive key shaft 130 is rearwardly retained in place by snap ring 165.

As will be more apparent on consideration of FIG. 4 hereinafter, the semi-circular insertably disengageable discharge port bearing mounting spider 108 is provided with a radially spaced alternating plurality of support ribs 166 and discharge port vacuum conduit openings 168, which allows for vacuum air flow through the workhead housing opening 116 at the interface of a surface being worked such as a boat hull bottom 14 and the abrading means working surface 114, up through the workhead housing interior and around the rotationally driven abrading units 112, thence through the discharge port vacuum conduit openings 168 into the discharge port 24 and out the vacuum conduit 22 to the vacuum source collection bags 28. The above described vacuum air flow circuit through the workhead housing 16 assembly is as indicated generally by the set of vacuum air flow arrows shown in FIG. 3, which is also the path of removed dust and debris from a surface being worked. Two additional effects are achieved by the described air flow path, the first of which is that fresh air is drawn over the rotating abrading units 112 thereby constantly cooling them and in turn thereby also reducing wear and loading up of the abrading means working surfaces 114 with removed dust and debris. And secondly, the direction of rotation of the abrading units 112 is in the direction of air flow, which imparts cooperative mechanical momentum thereto and assists in the vacuum air stream pick up and discharge of removed dust and debris.

Also shown in FIG. 3 is that two separate abrading units 112 are assembled in abuttable relationship upon the mandrel 110, which is exemplary of the use of a plurality of such abrading units 112 in such a manner and is not thereby intended to be restrictive. The operational advantage thus gained is that, especially in the case of flap wheel sanding drums as illustrated, the total lateral flap dimension is comprised of the sum of separate incremental such units in combination rather than a continuous one, which functionally results in better articulation thereof in accommodating work surface irregularities and dust and debris removal efficiency therefrom.

Figure 4:
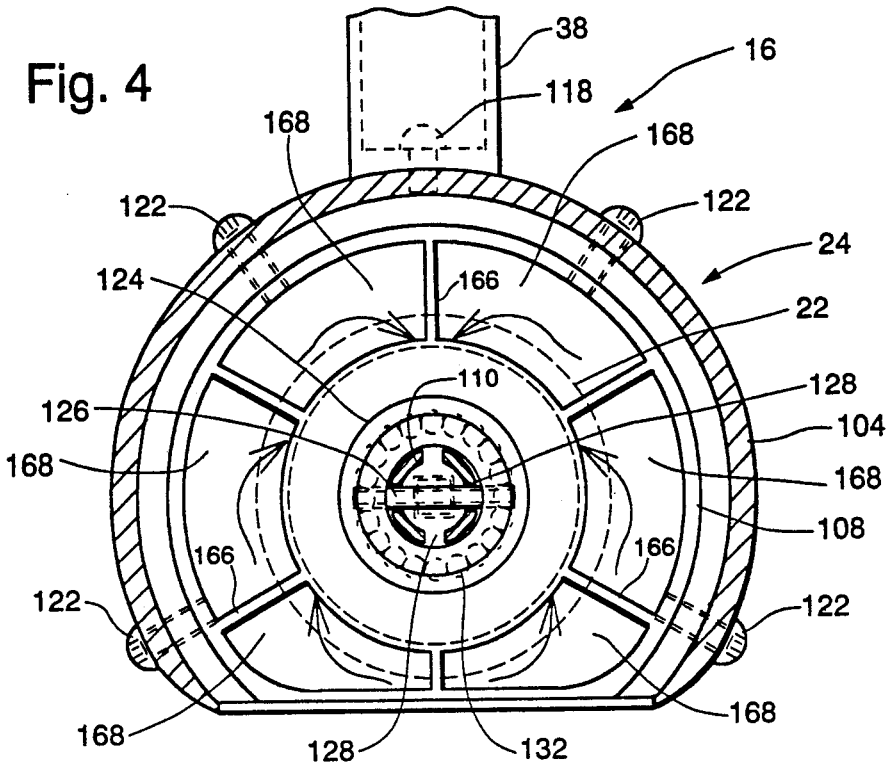
FIG. 4 is an end elevation view of the workhead housing discharge port, as shown in FIG. 3 and seen along the line 4—4 thereof.

The view shown in FIG. 4 is an end elevation of the workhead housing 16 discharge port 24, illustrating in clearer detail the radially spaced alternating plurality of support ribs 166 and discharge port vacuum conduit openings 168 thereof, and the vacuum air flow path therethrough into the vacuum conduit 22. It will also be noted, as more clearly herein illustrated, that a pair of mandrel shaft drive slots 128, set at right angles to one another in the drive engagement end of the mandrel 110, are provided for interchange in order to accommodate wear.

Figure 5:
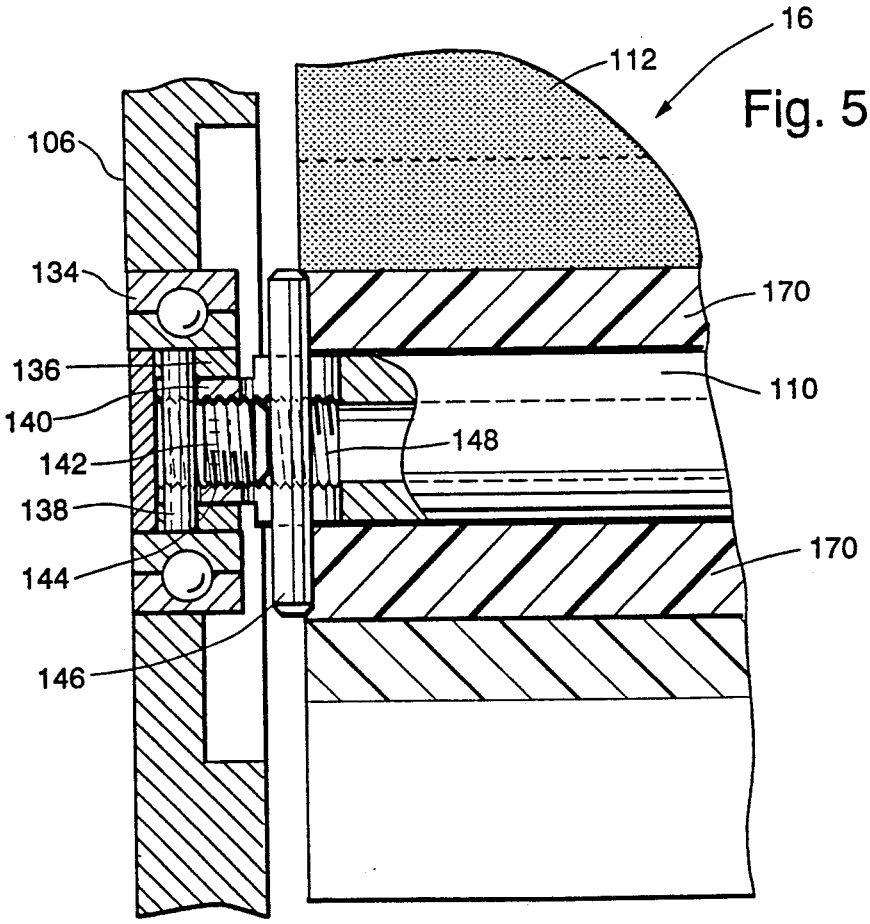
FIG. 5 is a side sectional view of the flap wheel and mandrel securing assembly, as shown in FIG. 3 and seen along the line 5—5 thereof.

Referring now to the enlarged side sectional view shown in FIG. 5, being that of the idler key assembly for supporting the free rotating end of the removable abrading unit mandrel 110. Also shown in greater detail is the previously described abrading unit retaining means comprised of the set screw 142 threadably engaging through the axially aligned mandrel shaft threaded opening 144 compressively against the abrading unit retention roll pin 146, in turn compressively against the abrading unit hub cylinder 170 whereby said abrading units 112 are secured upon the removable abrading unit mandrel 110.

Figure 6:
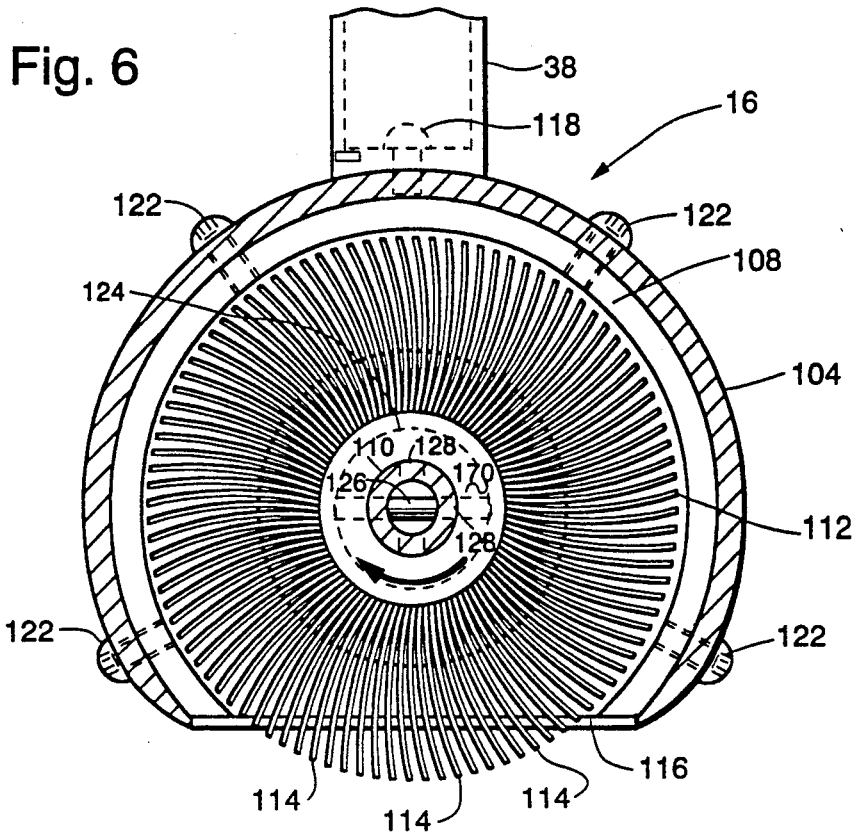
FIG. 6 is a side elevation view of one of the two workhead flap wheel sanding drums taken at the plane of abuttment thereof, as shown in FIG. 3 and seen along the line 6—6 thereof.
Figure 7:
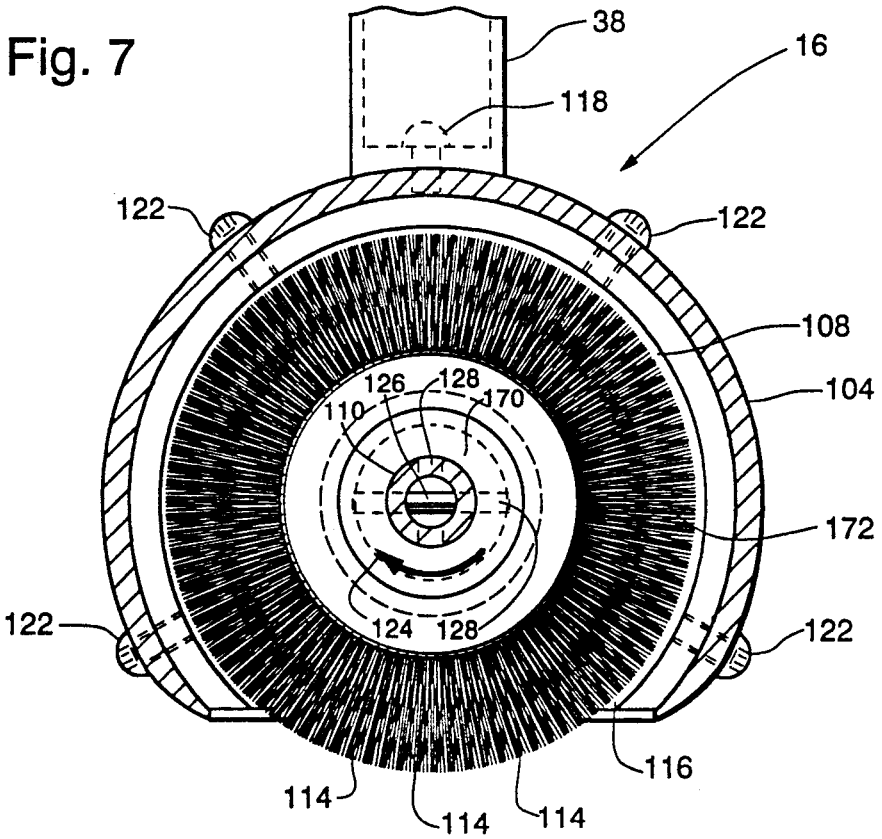
FIG. 7 is an illustration similar to that as shown in FIG. 6, but with a rotary wire brush unit installed in replacement of the workhead flap wheel sanding drums.

The respective views shown in FIGS. 6 and 7 illustrate first the installation of flap wheel sanding drums 112 upon the removable abrading unit mandrel 110 and a clearer depiction of how the abrading means working surfaces 114 rotationally articulate through the workhead housing opening 116 in a rotational direction as indicated by the arrow. It will be noted that the opening 116 provides a means whereby resilient compression of the abrading means working surfaces 114 against a working surface such as a boat hull bottom 14, for example, during operational use of hand-held workhead housing 16 enables effective sealing of said opening such that removed dust and debris are more efficiently picked up and transported for collection by the vacuum air flow stream and do not substantially escape to the ambient work area environment 30. The view in FIG. 7 illustrates a replacement of the flap wheel sanding drums 112, by the method previously described, with a wire brush abrading means 172 the operational functioning of which is similar to that as described for the flap wheel sanding drums 112 but the use of which is for changed operational requirements with respect to work surface cleaning, conditioning, material of construction, or other such considerations. It is to be further noted that the mandrel 110 may also be fitted with other work surface contact conditioning means such as buffing wheels and the like.

Figure 8:
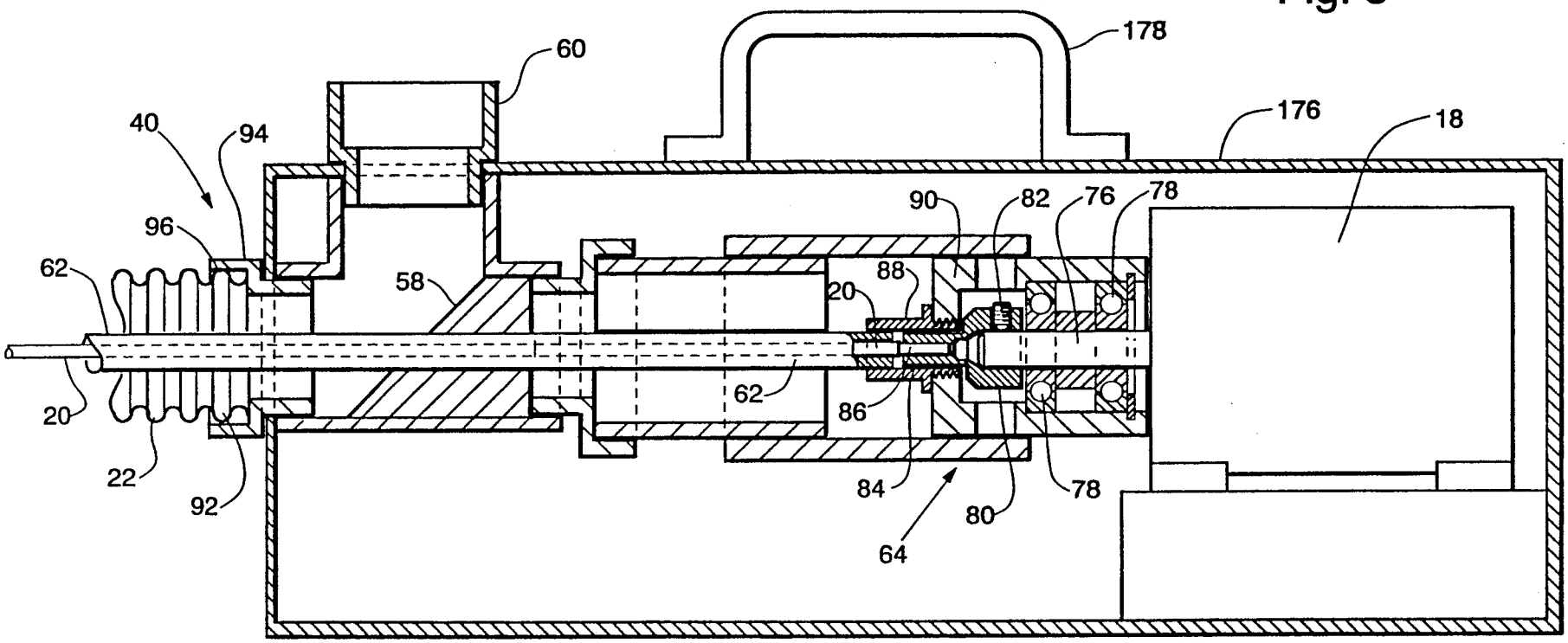
FIG. 8 is a cut-away side elevation view of an alternative embodiment for the portable surface preparation abrading unit power source and vacuum system hookup.

Considering last the view shown in FIG. 8, which in cut-away side elevation illustrates an alternate portable surface preparation abrading unit power source and vacuum system hookup 174 such as would be employed for use with the portable surface preparation abrading unit working assembly 40 when a separate vacuum source is available such as in, for example, a plant or workshop environment equipped with a so-called "house vacuum" being a stationary self-contained and separately housed high capacity vacuum collection source provided with a vacuum conduit system having multiple connection stations throughout, wherein the advantages of the alternate hookup 174 being that of retained abrading unit and power source portability while utilizing to good advantage available high capacity vacuum source capability and capacity. The alternate hookup 174 is protectively housed within a carrying enclosure 176 which is provided with a carrying handle 178 for accommodating manually displaced movement and positioning with connection to the house vacuum being at the auxilliary vacuum conduit intake 60. The motor coupling 64 is as was previously described, and connection of the flexible drive shaft 20 to the workhead drive shaft coupling 152 likewise as previously described. Another advantage of the alternate hookup 174 is that a power source 18 may be more appropriately sized to the abrading load, or with multiple alternate hookup 174 units of different power source 18 horsepower, be interchanged to accommodate different abrading loads.

Although the portable surface preparation abrading unit invention hereof, the structural and functional characteristics and methods of employment thereof, respectively have been shown and described in what is conceived to be the most practical and preferred embodiment, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

We claim:

1. A portable surface preparation abrading unit, said abrading unit comprising in combination a workhead housing adapted to support a rotationally driven abrading means, a removable plurality of workhead housing assembly screws to enable disassembly of said workhead housing, a removable abrading unit mandrel upon which said rotationally driven abrading means is insertably assembled within said workhead housing, a drive key having a drive key roll pin insertably engaging a mandrel shaft drive slot within said removable abrading unit mandrel at a drive end thereof, a set screw threadably adjustable within an axially aligned mandrel shaft threaded opening at a idler end of said removable abrading unit mandrel to compressively engage an abrading unit retention roll pin within an elongated slot therewithin to in turn compressively engage said rotationally driven abrading means insertably assembled thereon, an idler key roll pin insertably engaging a mandrel shaft idler slot within said removable abrading unit mandrel at the idler end thereof, a flexible drive shaft interconnecting said rotationally driven abrading means from the removable abrading unit mandrel drive end thereof to a remote power source, and a vacuum conduit interconnecting said workhead housing to an auxiliary vacuum conduit intake connectably communicating with an auxilliary vacuum conduit of a vacuum source.

2. A portable surface preparation abrading unit according to claim 1 wherein said rotationally driven abrading means is a plurality of flap wheel sanding drums.

3. A portable surface preparation abrading unit according to claim 1 wherein said rotationally driven abrading means is a wire brush.

4. A portable surface preparation abrading unit according to claim 1 wherein said remote power source is an electric motor.

5. A portable surface preparation abrading unit according to claim 4 wherein said vacuum source is an industrial vacuum cleaner.

6. A portable surface preparation abrading unit according to claim 4 wherein said vacuum source is a house vacuum.

7. A portable surface preparation abrading unit according to claim 5 wherein said industrial vacuum cleaner is adapted to accommodate a set of collection bags.

8. A portable surface preparation abrading unit according to claim 5 wherein said industrial vacuum cleaner is adapted to enclosably support said electric motor with a flexible drive shaft motor coupling interconnecting said flexible drive shaft thereto.

9. A portable surface preparation abrading unit according to claim 5 wherein said flexible drive shaft interconnecting said rotationally driven abrading means to said electric motor is snaked through said vacuum conduit interconnecting said workhead housing to said industrial vacuum cleaner.

10. A portable surface preparation abrading unit according to claim 6 wherein said flexible drive shaft interconnecting said rotationally driven abrading means to said electric motor is snaked through said vacuum conduit interconnecting said workhead housing to said house vacuum.

11. A portable surface preparation abrading unit according to claim 1 wherein said workhead housing is provided with a handle.

12. A portable surface preparation abrading unit according to claim 5 wherein said industrial vacuum cleaner is provided with a set of pneumatic tires.

13. A portable surface preparation abrading unit according to claim 6 wherein said electric motor is separate from said house vacuum.

14. A portable surface preparation abrading unit according to claim 13 wherein said electric motor with a flexible drive shaft motor coupling interconnecting said flexible drive shaft to said electric motor is protectively housed within a carrying enclosure.

* * * * *